US009354591B2

(12) United States Patent
Lee et al.

(10) Patent No.: US 9,354,591 B2
(45) Date of Patent: May 31, 2016

(54) WASTE TONER COLLECTING STRUCTURE OF AN IMAGE FORMING APPARATUS

(71) Applicant: Samsung Electronics Co., Ltd, Suwon-si, Gyeonggi-do (KR)

(72) Inventors: Han-jun Lee, Goyang-si (KR); Jin-ho Park, Yongin-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/334,808

(22) Filed: Jul. 18, 2014

(65) Prior Publication Data

US 2015/0023708 A1 Jan. 22, 2015

(30) Foreign Application Priority Data

Jul. 18, 2013 (KR) ..... 10-2013-0084860

(51) Int. Cl.
*G03G 21/00* (2006.01)
*G03G 21/10* (2006.01)

(52) U.S. Cl.
CPC ..... *G03G 21/105* (2013.01)

(58) Field of Classification Search
CPC ..... G03G 21/12; G03G 21/105
USPC ..... 399/358–360
See application file for complete search history.

(56) References Cited

U.S. PATENT DOCUMENTS 5,349,427 A * 9/1994 Benedict et al. ..... 399/360
2011/0103821 A1 5/2011 Akiyama

FOREIGN PATENT DOCUMENTS

JP 2007-041331 2/2007
JP 2011-095646 5/2011
JP 2012-027285 2/2012

* cited by examiner

*Primary Examiner* — Hoang Ngo
(74) *Attorney, Agent, or Firm* — Staas & Halsey LLP

(57) ABSTRACT

A waste toner collecting structure of an image forming apparatus includes a waste toner collector to be removably installed in a main body of an image forming apparatus to collect waste toner that is exhausted through exhaust holes of at least one waste toner exhaust parts installed in the main body a negative pressure generator to form negative pressure around shutters of the waste toner exhaust parts that open and close the exhaust holes, to form an intake air current into the waste toner collector and a waste toner separator to be connected to the waste toner collector to separate some of the waste toner, which flows into the waste toner collector and then moves toward the negative pressure generator, from air in order to collect the waste toner.

16 Claims, 5 Drawing Sheets

WASTE TONER COLLECTING STRUCTURE OF AN IMAGE FORMING APPARATUS

CROSS-REFERENCE TO RELATED APPLICATIONS

This application claims priority under 35 U.S.C. §119 from Korean Patent Application No. 10-2013-0084860, filed on Jul. 18, 2013, in the Korean Intellectual Property Office, the disclosure of which is incorporated herein by reference in its entirety.

BACKGROUND OF THE INVENTION

1. Field of the Invention

The present general inventive concept generally relates to providing a waste toner collecting structure of an image forming apparatus, and more particularly, to providing a waste toner collecting structure of an image forming apparatus that inhales waste toner, which flows into a waste toner transfer path, into a cyclone collector to collect the waste toner.

2. Description of the Related Art

In general, a conventional image forming apparatus using an electronic picture process includes a photosensitive medium cleaning unit that removes waste toner that is not transferred from a photosensitive medium and remains in the photosensitive medium.

The photosensitive medium cleaning unit includes a cleaning member that physically cleans a surface of the photosensitive medium and a plurality of waste toner and a plurality of waste toner exhaust parts that collect waste toner scrapped by the cleaning member and exhausts the collected waste toner into a waste toner collecting container.

The plurality of waste toner exhaust parts include transfer screws to be delivered waste toner scrapped by the cleaning member without being agglomerated. The plurality of waste toner exhaust parts respectively include exhaust holes to exhaust waste toner and single or double shutters to open and/or close the exhaust holes.

However, since an existing waste toner collecting structure depends on the single or double shutters and sealing structures around the single or double shutters, the existing waste toner collecting structure prevents pollution caused by waste toner, depending on only the single or double shutters installed in the waste toner exhaust parts and the sealing parts around the single or double shutters. In other words, the existing waste toner collecting structure varies depending on gaps and step differences between the single or double shutters and structures around the single or double shutters to prevent pollution of the waste toner.

If mechanical gaps and step differences exist in the exhaust holes of the waste toner exhaust parts, waste toner, which is to be collected into the waste toner collecting container due to self-load, is not collected into the waste toner collecting container and frequently remains around the single or double shutters. Also, if a speed of installing and removing the waste toner collecting container is fast, the single or double shutters are not completely closed the exhaust holes, and the waste toner leaks into the exhaust holes.

As described above, a gap and a step difference in an attachable and/or detachable structure that is mechanically not a single component may complicate design of a mechanical structure of the image forming apparatus. Therefore, surroundings of an image forming apparatus may be polluted due to waste toner.

SUMMARY OF THE INVENTION

The present general inventive concept provides a waste toner collecting structure of an image forming apparatus that forms negative pressure around shutters of waste toner exhaust parts to forcibly inhale waste toner into a waste toner collector.

Additional features and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a waste toner collecting structure including a waste toner collector to be removably installed in a main body of an image forming apparatus to collect waste toner that is exhausted through exhaust holes of at least one waste toner exhaust parts installed in the main body, a negative pressure generator to form negative pressure around shutters of the waste toner exhaust parts that open and close the exhaust holes, to form an intake air current into the waste toner collector, and a waste toner separator to be connected to the waste toner collector to separate some of the waste toner, which flows into the waste toner collector and then moves toward the negative pressure generator, from air in order to collect the waste toner.

The intake air current may be formed from a periphery of the shutters to a fan motor through an inside of the waste toner collector and the waste toner collector.

The waste toner separator may be disposed to be connected to the negative pressure generator.

The waste toner collector and the waste toner separator may be formed into a single body and may be removably installed in the main body of the image forming apparatus.

The negative pressure generator may be disposed in the main body of the image forming apparatus.

The waste toner separator may include a cyclone tank to separate the waste toner flowing with air from the air by a centrifugal force; and a waste toner collecting container to collect the waste toner separated from the air.

The cyclone tank may be connected to a side of the waste toner collector through a connection duct.

The connection duct may be positioned at a height corresponding to the waste toner exhaust parts.

The connection duct may be disposed to keep a distance from a bottom of the waste toner collector.

The cyclone tank may include an air exhaust duct that is disposed in a longitudinal direction of the cyclone tank inside the cyclone tank so as to exhaust the air separated from the waste toner toward the negative pressure generator.

The waste toner collecting structure may further include a filter to be disposed on an exhaust path of air exhausted from the negative pressure generator to filter air exhausted through the negative pressure generator.

The negative pressure generator may be a fan motor.

The foregoing and/or other aspects and utilities of the present general inventive concept may also be achieved by providing a waste toner collecting structure of an image forming apparatus, including, a negative pressure generator to be installed in a main body of the image forming apparatus to form negative pressure around shutters that open and close exhaust holes of at least one waste toner exhaust parts, a waste toner collector to be removably installed in the main body to collect waste toner exhausted through the exhaust holes, and a filter to be disposed on an exhaust path of air exhausted from the negative pressure generator to filter air exhausted from the negative pressure generator. An inhaling flow path may be formed by the negative pressure generator from a periphery of the shutters to the fan motor through an inside of the waste toner collector.

The waste toner collecting structure may further include an additional filter to be disposed on an air inflow path of the negative pressure generator.

The waste toner collecting structure may further include a connection induct to be positioned at a height corresponding to the waste toner exhaust parts and to be disposed to keep a distance from a bottom of the waste toner collector.

The foregoing and/or other aspects and utilities of the present general inventive concept may also be achieved by providing a waste toner collecting structure, including a waste toner collector to collect waste toner within an image forming apparatus, a negative pressure generator to form an intake air current into the waste toner collector; and a waste toner separator to be connected to the waste toner collector to separate and collect particles of the waste toner that are floating within the waste toner collector.

The waste toner collector may include at least one waste toner exhaust part to transfer the waste toner into a collecting space of the waste toner collector, the at least one waste toner exhaust part including at least one insertion hole to receive the waste toners, at least one exhaust hole to exhaust the waste toner into the collecting space, and at least one shutter to open and close the at least one exhaust hole.

The negative pressure generator may form negative pressure around the at least one shutter to open and close the at least one exhaust hole.

The intake air current may be formed by the negative pressure to strongly inhale the waste toner remaining around the at least one shutter into the collecting space.

The waste toner separator may include a cyclone tank to form a circulating air current to separate the floating particles of the waste toner from air within the collecting space by using a centrifugal force, and a container to collect the separated particles of the waste toner.

At least one of the waste toner collector and the waste toner separator may be removably installed within a main body of the image forming apparatus.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
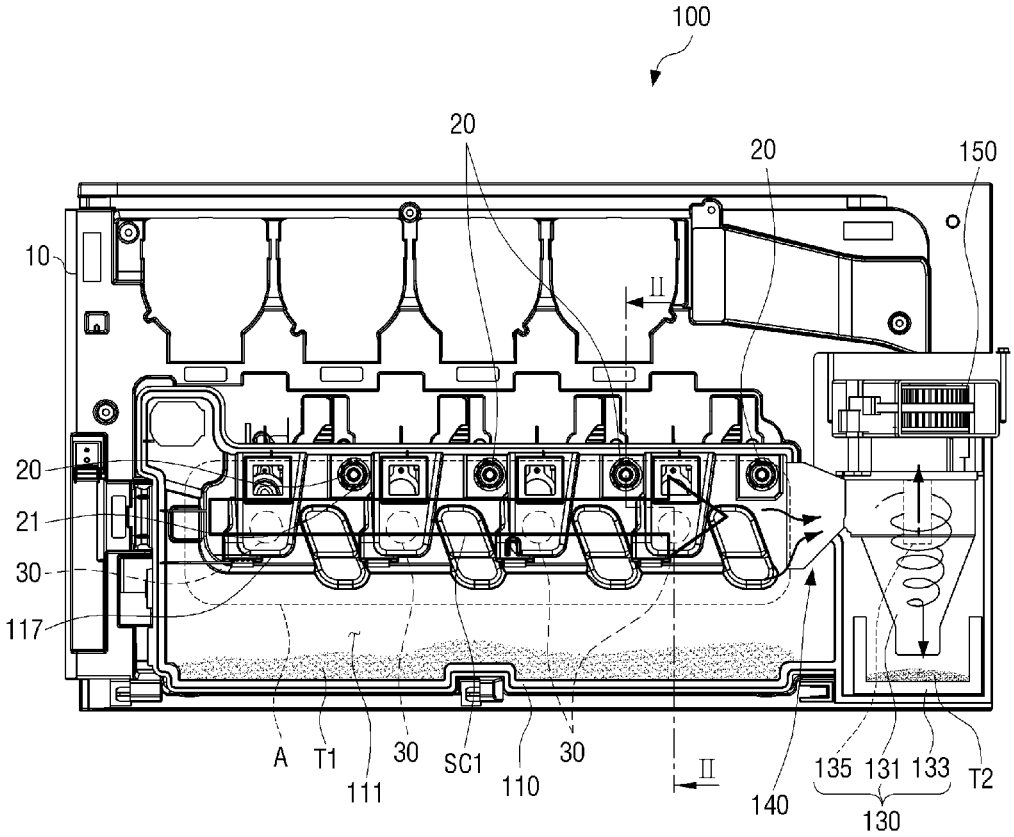
FIG. 1 is a schematic cross-sectional view illustrating a waste toner collecting structure of an image forming apparatus according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

A waste toner collecting structure 100 of an image forming apparatus according to an exemplary embodiment of the present general inventive concept will now be described in detail with reference to FIGS. 1 through 4. The image forming apparatus including the waste toner collecting structure 100 described in the present general inventive concept may be one of a printer, a copier, a fax machine, a multifunction peripheral (MFP), etc., but is not limited thereto.

Referring to FIG. 1, the waste toner collecting structure 100 of the present exemplary embodiment includes a waste toner collector 110 and a waste toner separator 130 that are installed to be separated from a main body 10 of the image forming apparatus, and a negative pressure generator 150 that is installed to be fixed into the main body 10.

The waste toner collector 110 includes a collecting space 111 that is formed inside the waste toner collector 110 to collect waste toner T1. The waste toner collector 110 also collects waste toner that is exhausted from exhaust holes 21 and 31 (refer to FIG. 2) of a plurality of first waste toner exhaust parts 20 and a plurality of second waste toner exhaust parts 30 that are installed in the main body 10. The plurality of first waste toner exhaust parts 20 and the plurality of second waste toner exhaust parts 30 can be arranged together in a single waste toner exhaust structure A, but is not limited thereto.

The first and second waste toner exhaust parts 20 and 30 transfer waste toner, which is exhausted from photosensitive drums (not illustrated) and developers (not illustrated), into the waste toner collector 110.

Figure 2:
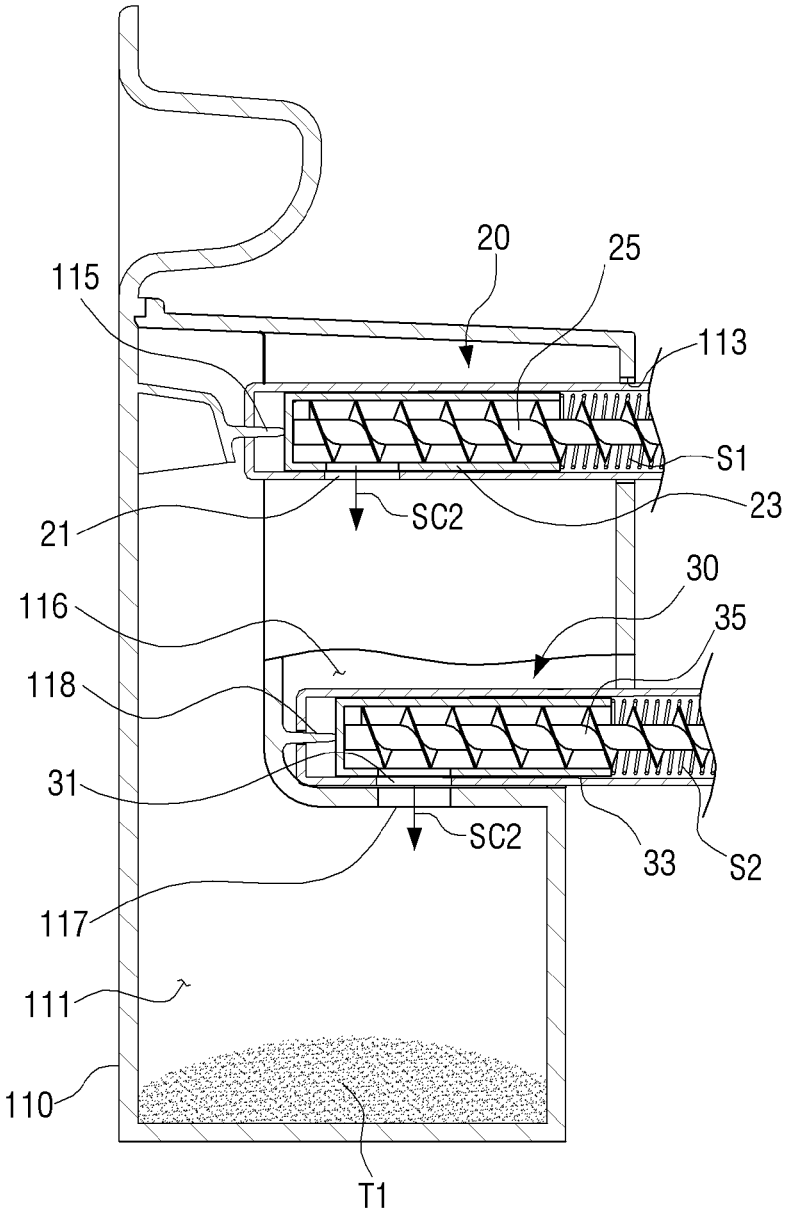
FIG. 2 is a cross-sectional view taken along line II-II of FIG. 1.

Referring to FIG. 2, the plurality of first waste toner exhaust parts 20 include transfer screws 25 to transfer waste toner and exhaust waste toner, which flows into a plurality of insertion holes 113 formed in a side of the waste toner collector 110, to the collecting space 111 of the waste toner collector 110.

When the waste toner collector 110 is installed in the main body 10, shutters 23 of the plurality of first waste toner exhaust parts 20 go back by a plurality of push projections 115 that project from an inner wall of the waste toner collector 110 to open the exhaust holes 21. In this case, back ends of the shutters 23 are elastically supported by an elastic member S1.

Therefore, the exhaust holes 21 of the first waste toner exhaust parts 20 drop waste toner, which flows into the waste toner collector 110, to a bottom surface of the waste toner collector 110.

The plurality of second waste toner exhaust parts 30 include transfer screws 35 and shutters 33 that may be formed in the same structures as the first waste toner exhaust parts 20. In other words, the plurality of second waste toner exhaust parts 30 may include the shutters 33 that go back by a push projection 118 of a groove part 116 that is formed on an outer side of the waste toner collector 110. In this case, the shutters 33 are elastically supported by an elastic member S2.

When the waste toner collector 110 is installed in the main body 10, the shutters 33 open the exhaust holes 31 by the push projection 118. In this case, differently from the plurality of first waste toner exhaust parts 20, the plurality of waste toner exhaust parts 30 are not inserted into the waste toner collector 110 and are positioned in the groove part 116 of the waste toner collector 110.

The exhaust holes 31 of the plurality of second waste toner exhaust parts 30 are set in positions corresponding to a plurality of collecting holes 117 of the waste toner collector 110 to drop exhausted waste toner into the collecting holes 117. Here, gaps between the exhaust holes 31 of the plurality of second waste toner exhaust parts 30 and the collecting holes 117 are minimally kept not to leak waste toner leaks through the gaps.

The collecting space 111 of the waste toner collector 110 is much larger than a very narrow gap that is formed when forming a predetermined escape structure, to operate the exhaust holes 21 and 31 and the shutters 23 and 33 around the exhaust holes 21 and 31. Therefore, when the negative pressure generator 150 operates, second negative pressure lower than first negative pressure is formed around the shutters 23 and 33 when the first negative pressure is formed in the collecting space 111 of the waste toner collector 110.

Therefore, since intake air SC2 is formed around the shutters 23 and 33 and flows faster than intake air SC1 that is formed inside the waste toner collector 110, waste toner remaining around the shutters 23 and 33 may be inhaled and collected into the collecting space 111 through strong pressure.

Figure 3:
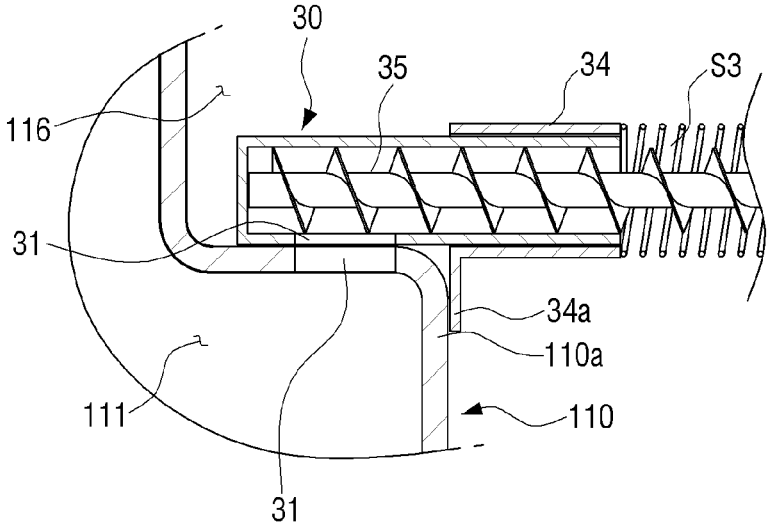
FIG. 3 is an enlarged view illustrating a second waste toner exhaust part of FIG. 2, according to an exemplary embodiment of the present general inventive concept.

Referring to FIG. 3 shutters 34 of the plurality of second waste toner exhaust parts 30 may be arranged outside the second waste toner exhaust parts 30, which is different from the shutters 33 arranged inside the second waste toner exhaust parts 30.

In other words, a shutter 34 is combined with the second waste toner exhaust part 30 to slide on an outer surface of the second waste toner exhaust part 30. When the waste toner collector 110 is installed in the main body 10, a hanging projection 34*a* of the shutter 34 that extends from a front end of the shutter 34 is pushed toward the main body 10 by an outer portion 110*a* of the waste toner collector 110 to open the exhaust hole 31. In this case, the shutter 34 is elastically supported by an elastic member S3.

The waste toner separator 130 is disposed between the waste toner collector 110 and the negative pressure generator 150 and is connected to a side to the waste toner collector 110 through a connection duct 140. In this case, the waste toner separator 130 and the waste toner collector 110 may be formed into a single body, and thus the waste toner collector 110 and the waste toner separator 130 may be installed in and removed from the main body 10.

The waste toner separator 130 includes a cyclone tank 131, a waste toner collecting container 133, and an air exhaust duct 135.

The cyclone tank 131 includes an upper part that has an approximately cylindrical shape and a lower part that has a funnel shape with a diameter narrowing downwards. A side of the upper part of the cyclone tank 131 is connected to the connection duct 140 to allow waste toner particles floating in the collecting space 111 of the waste toner collector 110 to flow into the cyclone tank 131.

When the waste toner particles floating in the collecting space 111 of the waste toner collector 110 flow with air due to an intake air current, the cyclone tank 131 forms a circulating air current to separate waste toner particles T2 from air by a centrifugal force.

The waste toner particles t2 that have been separated from the air circle downwards along a lower inner wall of the cyclone tank 131 to be collected into the waste toner collecting container 133 that is disposed under the cyclone tank 131. In this case, the air that has been separated from the waste toner particles T2 is inhaled toward the negative pressure generator 150 through the air exhaust duct 135.

The air exhaust duct 135 may be disposed along a longitudinal direction of the cyclone tank 131 to smoothly circle an air current that has flowed into the cyclone tank 131 and may be positioned on the same axis as a central axis of the cyclone tank 131. An upper end of the air exhaust duct 135 is connected to the negative pressure generator 150 to guide air, which flows into a lower end of the air exhaust duct 135, to the negative pressure generator 150.

The connection duct 140 may be disposed to keep a predetermined distance from a bottom of the waste toner collector 110 in order to minimize inhalation of waste toner T1, which sinks onto the bottom of the waste toner collector 110, into the connection duct 140.

The connection duct 140 may be set at a height corresponding to the first and second waste toner exhaust parts 20 and 30. In this case, the intake air current SC1 formed in the collecting space 111 of the waste toner collector 110 is formed approximately in an upper area A of the collecting space 111 along the longitudinal direction of the waste toner collector 110. Therefore, scattering of the waste toner T1, which sinks on the bottom of the waste toner collector 110, may be minimized by the intake air current SC1 formed in the collecting space 111.

The negative pressure generator 150 is installed in the main body 10 and is supplied with power through predetermined electric wiring (not illustrated) to operate. The negative pressure generator 150 may include a fan motor that generates an inhaling force by using a fan that rotates in the present exemplary embodiment but is not limited thereto. The negative pressure generator 150 may be a small-sized inhaling pump to work the inhaling force all over the waste toner collector 110 and the waste toner separator 130, but is not limited thereto.

When the negative pressure generator 150 operates, an inhaling flow path is formed from the periphery of the shutters 23 and 33 to the negative pressure generator 150 through the waste toner separator 130.

Here, the intake air current SC2 having a fast flow speed may be formed by negative pressure generated around the shutters 23 and 33 so as to strongly inhale waste toner remaining around the shutters 23 and 33 into the collecting space 111 of the waste toner collector 110.

In this case, since the intake air current SC1, which has a relatively lower flow speed than the intake air current SC2 generated around the shutters 23 and 33, is formed in the collecting space 111. Therefore, most of waste toner remaining around the exhaust holes 21 and 31 and the shutters 23 and 33 is piled on the bottom of the collecting space 111, and waste toner particles floating in the collecting space 111 flow into the waste toner separator 130 along the inhaling flow path and then is separated from air by a centrifugal force to be collected into the waste toner collecting container 133.

Figure 4:
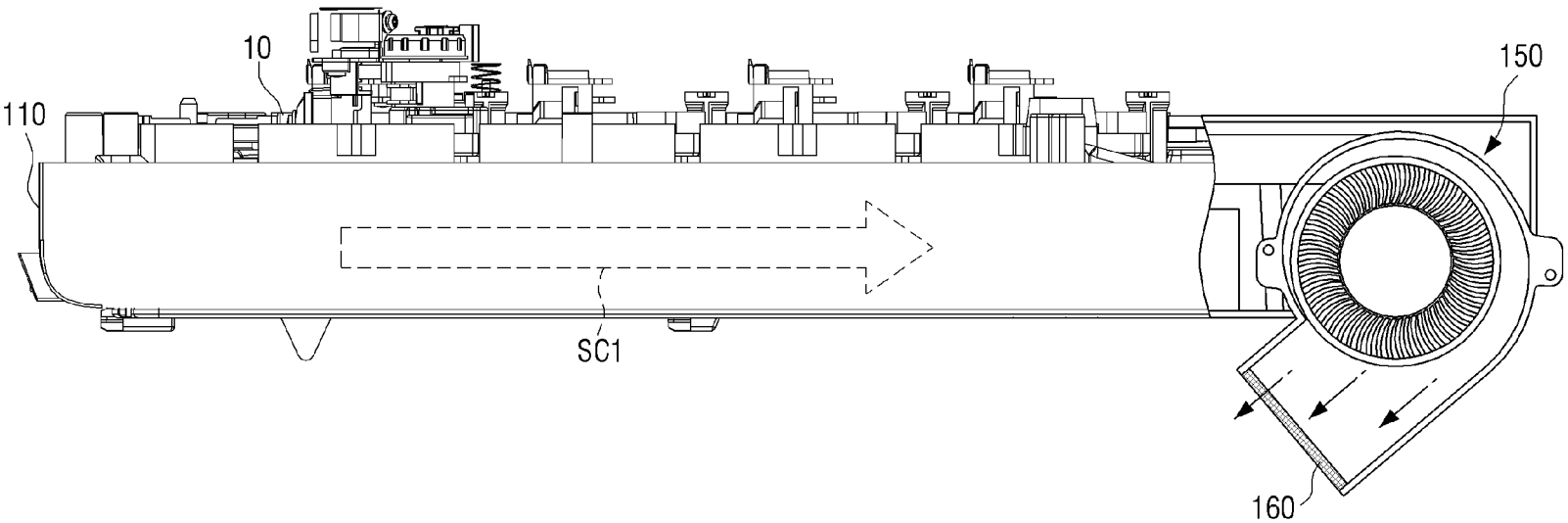
FIG. 4 is a schematic cross-sectional view illustrating a waste toner collecting structure of an image forming apparatus according to an exemplary embodiment of the present general inventive concept.

Referring to FIG. 4, in the present exemplary embodiment, a filter 160 is disposed at a place of an air exhaust path that exhausts air through the negative pressure generator 150 to secondly filter micro waste toner particles included in air firstly filtered in the cyclone tank 131

In this case, air that has been filtered through the filter 160 may be used for various purposes, such as an air curtain, etc. to dry toner of a paper sheet passing through a fixing unit.

In the present exemplary embodiment, parts of the first waste toner exhaust parts 20 in which the exhaust holes 21 are formed are inserted into the waste toner collector 110. Also, when the second waste toner exhaust parts 30 are positioned outside the waste toner collector 110, the exhaust holes 31 are adjacent to the collecting hole 117 of the waste toner collector 110. However, the first and second waste toner exhaust parts 20 and 30 are not limited thereto, and the exhaust holes 21 and 31 of the first and second waste toner exhaust parts 20 and 30 may be set in various positions according to a structure of the waste toner collector 110 or an installation structure between the waste toner collector 110 and the main body 10.

In other words, the structure of the waste toner collector 110 may be changed so that the exhaust holes 21 and 31 are positioned inside or outside the waste toner collector 110. In this case, the shutters 23 and 33 installed in the first and second waste toner exhaust parts 20 and 30 may be positioned inside or outside the waste toner collector 110 according to positions of the exhaust holes 21 and 31.

Figure 5:
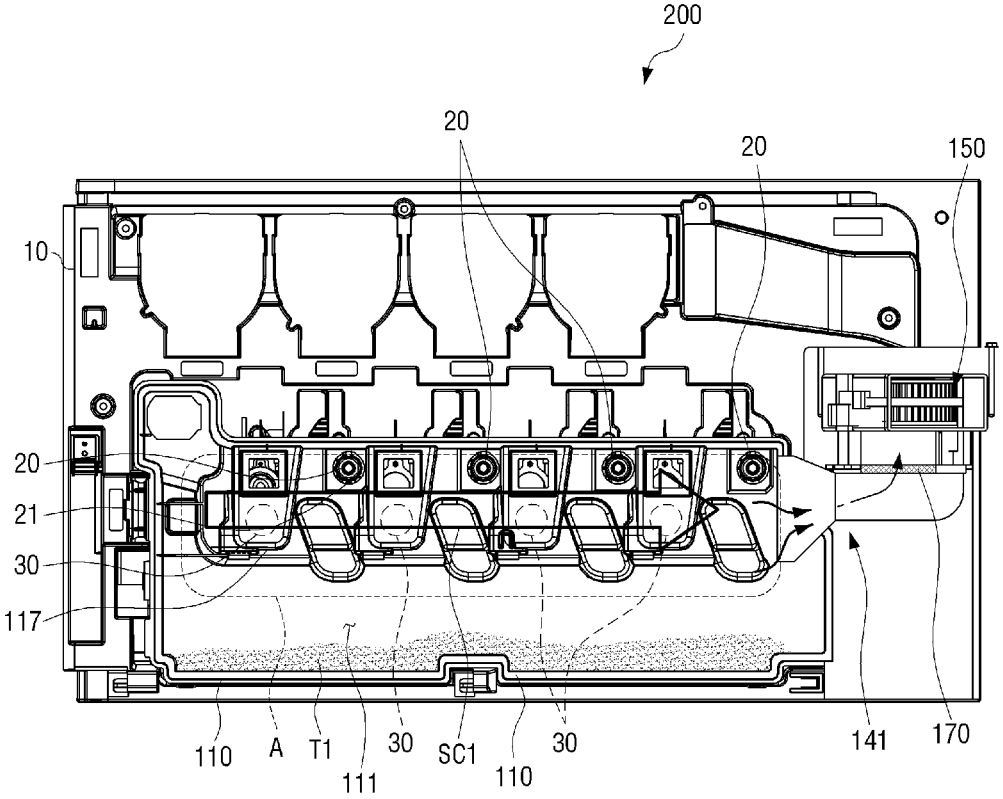
FIG. 5 is a schematic cross-sectional view illustrating a waste toner collecting structure of an image forming apparatus according to another exemplary embodiment of the present general inventive concept.

A waste toner collecting structure 200 according to another exemplary embodiment of the present general inventive concept will now be described with reference to FIG. 5. The waste toner collecting structure 200 of the present exemplary embodiment of FIG. 5 is similar to the waste toner collecting structure 100 of the previous exemplary embodiment of FIGS. 1 through 4. Also, the same parts of the present exemplary embodiment as those of the previous exemplary embodiments are denoted by the same reference numerals, and their detailed descriptions are omitted.

The waste toner separator 130 is omitted from the waste toner collecting structure 200 according to the present exemplary embodiment of FIG. 5, and the waste toner collector 110 is directly connected to the negative pressure generator 150 through a connection duct 141.

A side of the connection duct 141 is connected to the waste toner collector 110, and an other side of the connection duct 141 is connected to an air inhaling side of the negative pressure generator 150.

Like the connection duct 140 of the previous exemplary embodiment, the connection duct 141 may be disposed to keep a predetermined distance from the bottom of the waste toner collector 110 so as not to inhale waste toner, which sinks and is collected on the bottom of the waste toner collector 110, into the connection duct 141 and may be set at a height approximately corresponding to the first and second waste toner exhaust parts 20 and 30.

Therefore, scattering of the waste toner, which sinks on the bottom of the waste toner collector 110, may be minimized by an intake air current SC1 that is formed in the collecting space 111 of the waste toner collector 110.

Air which is directly inhaled from the collecting space 111 of the waste toner collector into the negative pressure generator 150 may include waste toner particles. A prefilter 170 may be disposed on an air inhaling path of the negative pressure generator 150, for example, inside the connection duct 141, to filter the waste toner particles. Also, the filter 160 may be disposed on an air exhaust path of the negative pressure generator 150 to dually filter the waste toner particles, which is included in the air exhausted from the collecting space 111 of the waste toner collector 110, through the prefilter 170 and the filter 160.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A waste toner collecting structure, of an image forming apparatus, comprising:

a waste toner collector to be removably installed in a main body of an image forming apparatus to collect waste toner that is exhausted through exhaust holes of at least one waste toner exhaust parts installed in the main body;

a negative pressure generator to form negative pressure around shutters of the waste toner exhaust parts that open and close the exhaust holes, to form an intake air current into the waste toner collector; and a waste toner separator to be connected to the waste toner collector to separate some of the waste toner, which flows into the waste toner collector and then moves toward the negative pressure generator, from air in order to collect the waste toner, wherein the waste toner separator comprises, a cyclone tank to separate the waste toner following with air from the air by using a centrifugal force; and a waste toner collecting container to collect the waste toner separated from the air.

2. The waste toner collecting structure of claim 1, wherein the intake air current is formed from a periphery of the shutters to a fan motor through an inside of the waste toner collector and the waste toner collector.

3. The waste toner collecting structure of claim 1, wherein the waste toner separator is disposed to be connected to the negative pressure generator.

4. The waste toner collecting structure of claim 1, wherein the waste toner collector and the waste toner separator are formed into a single body and are removably installed in the main body of the image forming apparatus.

5. The waste toner collecting structure of claim 4, wherein the negative pressure generator is disposed in the main body of the image forming apparatus.

6. The waste toner collecting structure of claim 1, wherein the cyclone tank is connected to a side of the waste toner collector through a connection duct.

7. The waste toner collecting structure of claim 6, wherein the connection duct is positioned at a height corresponding to the waste toner exhaust parts.

8. The waste toner collecting structure of claim 7, wherein the connection duct is disposed to keep a distance from a bottom of the waste toner collector.

9. The waste toner collecting structure of claim 1, wherein the cyclone tank comprises an air exhaust duct that is disposed in a longitudinal direction of the cyclone tank inside the cyclone tank so as to exhaust the air separated from the waste toner toward the negative pressure generator.

10. The waste toner collecting structure of claim 1, further comprising:

a filter to be disposed on an exhaust path of air exhausted from the negative pressure generator to filter air exhausted through the negative pressure generator.

11. The waste toner collecting structure of claim 1, wherein the negative pressure generator is a fan motor.

12. A waste toner collecting structure, of an image forming apparatus, comprising:

a waste toner collector to collect waste toner within an image forming apparatus;

a negative pressure generator to form an intake air current into the waste toner collector; and a waste toner separator to be connected to the waste toner collector to separate and collect particles of the waste toner that are floating within the waste toner collector, wherein the waste toner separator comprises, a cyclone tank to form a circulating air current to separate the floating particles of the waste toner from air within a collecting space by using a centrifungal force; and a container to collect the separated particles of the waste toner.

13. The waste toner collecting structure of claim 12, wherein the waste toner collector comprises at least one waste toner exhaust part to transfer the waste toner into a collecting space of the waste toner collector, the at least one waste toner exhaust part comprising:

at least one insertion hole to receive the waste toners, at least one exhaust hole to exhaust the waste toner into the collecting space, and at least one shutter to open and close the at least one exhaust hole.

14. The waste toner collecting structure of claim 13, wherein the negative pressure generator forms negative pressure around the at least one shutter to open and close the at least one exhaust hole.

15. The waste toner collecting structure of claim 14, wherein the intake air current is formed by the negative pressure to strongly inhale the waste toner remaining around the at least one shutter into the collecting space.

16. The waste toner collecting structure of claim 12, wherein at least one of the waste toner collector and the waste toner separator are removably installed within a main body of the image forming apparatus.

* * * * *